US005990839A

United States Patent [19]

Schefte et al.

[11] Patent Number: 5,990,839

[45] Date of Patent: Nov. 23, 1999

[54] ADJUSTABLE ANTENNA SYSTEM FOR A PORTABLE RADIO UNIT IN A SATELLITE COMMUNICATION SYSTEM

[75] Inventors: Henry Schefte, deceased, late of Skärholmen, by Ann-Margret Schefte, legal representative; Sven Anders Gösta Derneryd, Hisings Backa; Jan Staffan Reinefjord, Djursholm, all of Sweden

[73] Assignee: Telefonaktiebolaget L M Ericsson (publ), Stockholm, Sweden

[21] Appl. No.: 09/057,367

[22] Filed: Apr. 8, 1998

[30] Foreign Application Priority Data

Apr. 10, 1997 [SE] Sweden ..... 9701322

[51] Int. Cl.[6] ..... H01Q 1/24; H01Q 1/38

[52] U.S. Cl. ..... 343/702; 343/700 MS; 343/880

[58] Field of Search ..... 343/702, 700 MS, 343/846, 893, 880, 881, 882; 455/89, 90; H01Q 1/24, 1/38

[56] References Cited

U.S. PATENT DOCUMENTS

| | | | |
|---|---|---|---|
| 4,992,799 | 2/1991 | Garay | 343/700 MS |
| 5,255,001 | 10/1993 | Tamura et al. | 343/702 |
| 5,337,061 | 8/1994 | Pye et al. | 343/702 |
| 5,451,965 | 9/1995 | Matsumoto | 343/702 |
| 5,513,383 | 4/1996 | Tsao | 343/702 |
| 5,542,104 | 7/1996 | Ozawa et al. | 343/702 |
| 5,542,106 | 7/1996 | Krenz et al. | 455/90 |
| 5,608,413 | 3/1997 | Macdonald | 343/700 MS |

OTHER PUBLICATIONS

*PCT International Search Report.* Jan. 23, 1993.

*Primary Examiner*—Hoanganh Le
*Attorney, Agent, or Firm*—Jenkens & Gilchrist, P.C.

[57] ABSTRACT

The present invention relates to an antenna unit for a portable radio unit capable of operating in a satellite communication mode. The antenna unit includes a first and a second conformal u-shaped antenna body which are movably arranged to each other. Each of the antenna bodies have a top surface and two outer surfaces. The second antenna body can be slid in and out of the first antenna body. The first antenna body has an array of patches on the top surface and on both of its outer surfaces to receive radio signals. The second antenna body has an array of patches on the top surface and on both of its outer surfaces to transmit radio signals. The antenna unit is coupled to the terminal unit by a hinge which enables the antenna unit to be folded onto the terminal unit.

44 Claims, 12 Drawing Sheets

ADJUSTABLE ANTENNA SYSTEM FOR A PORTABLE RADIO UNIT IN A SATELLITE COMMUNICATION SYSTEM

TECHNICAL FIELD OF THE INVENTION

The present invention relates to an antenna unit for transmitting and receiving signals from/to a portable radio unit in a satellite system.

DESCRIPTION OF RELATED ART

The name portable radio unit includes all portable equipment intended for radio communication, like mobile phones, pagers, telex, electronic notebooks and communicators. These equipments can be used in any type of radio communication system, such as cellular networks, satellite or small local networks.

One type of radio communication is cellular mobile communication where portable radio units communicate with each other or with fixed units through mobile basestations on the ground. Portable radio units, for example mobile phones, which typically transmit and receive signals at a frequency of approximately 900 Megahertz or 1800–1900 Megahertz (MHz), are well known.

Recently it has become important for a second type of radio communication, i.e. satellite communication.

In the near future, we will foresee communications by satellites directly to portable radio units. The satellites can reach portable radio units in areas where cellular communication is unavailable due to the lack of necessary cellular towers, base stations or compatible standards. Such satellite communications could allocate to the 2 Gigaherz (GHz) band and the 20/30 GHz bands. Several systems with high data rates (64 kbps and 2 Mbps) are in the planning stage.

It is recognised that separate antennas are necessary for cellular and satellite mode communication since cellular antennas usually are linearly polarised and satellite antennas usually are circularly polarised. A further difference is that the satellite communication mode involves a directional component, where link-margin is increased when the satellite antenna on the portable radio unit is pointed toward the satellite, and the cellular communication mode does not. Thus, the positioning of the satellite antenna in the mobile unit is very important, as is the construction of the satellite antenna.

One example of a portable radio unit is a portable phone. Flip covers for portable phones have generally been used to protect the keypad or the display and they have only extended over a part of the phone. In some applications, though, a flip cover has been utilised to house an antenna (e.g. U.S. Pat. No. 5,337,061, U.S. Pat. No. 5,542,106, U.S. Pat. No. 5,451,965).

The U.S. Pat. No. 5,337,061 describes an antenna unit in a flip cover comprising a ground plane and an active monopole. The flip cover is pivotally connected to a main section of a housing in a handset. The flip cover is folded down against the main section when not in use.

The U.S. Pat. No. 5,542,106 describes an antenna in a radiotelephone where the antenna is integrated into a movable housing element (a flip cover). The antenna being a half-wave dipole, however, other antennas could be substituted such as a loop antenna, a patch antenna or a monopole antenna.

The U.S. Pat. No. 5,451,965 describes a multi-directional antenna configuration. The antenna including two or more planes of antenna oriented in different directions, for receiving electromagnetic waves in various angels or directions. The antenna being a loop antenna.

As will be seen herein, each of the antennas disclosed in these patents is of a different construction than the satellite antenna of the present invention.

SUMMARY

The present invention meets a number of problems related to antennas on portable radio units in satellite communication systems.

One problem occurs when the satellite communication system is based on low flying satellites, i.e. LEO (Low Earth Orbits at 700–1500 km height) with an orbital period of about 100 minutes. Generally, the user (and the antenna) is within reach of one or more satellites during 2 to 10 minutes of this period. This requires that the antenna must be able to track and switch between different satellites during operation.

Another problem occurs when radio waves between the satellite and the portable radio unit are weak due to low output power, from the satellite or the portable radio unit, or attenuation in the radio wave propagation path between the satellites and the radio unit antenna. This requires higher radio unit antenna gain with extra margin.

A further problem occurs if the array antenna is moved or turned in such a way that the scan angle between the beam direction pointing at the satellite and a normal vector of the antenna array aperture becomes large. This requires that the antenna must be designed to maintain a reasonable receive and transmit quality at these large angles.

Yet another problem occurs if the margin in the link budget has to be increased in order to obtain a sufficient received signal quality or system economy. There are only a few variables in the link budget which can be changed without causing any negative consequences in other areas.

Another problem occurs if the antenna aperture area has to be larger than the portable radio unit's geometrical dimensions allow.

Still another problem is to avoid that the beam of the antenna unit is scattered by the user of the portable radio unit.

In light of the foregoing, a primary object of the present invention is to provide an antenna for a portable radio unit capable of operating in a satellite communication mode.

Another object of the present invention is to provide an antenna with steerable antenna beams.

A further object of the present invention is to increase the antenna aperture area to maintain a reasonable receive and transmit quality at large scan angles.

Yet another object of the present invention is to provide a highly directional antenna.

A further object of the present invention is to use the high directivity to divert the beam from the antenna away from the user of the portable radio unit, to reduce powerless and avoid scattering.

Yet another object of the present invention is to obtain highest possible antenna gain (antenna directivity) within the constraints of the portable radio unit's geometrical dimensions to increase the margin in the link budget.

Still another object of the present invention is to obtain high antenna gain even in those cases when the normal vector of the antenna aperture is pointing in another direction than the satellite position.

Another object of the present invention is to establish a beam sufficiently sharp to select one of several satellites which can be viewed from the site of the portable radio unit.

These objects and other features of the present invention will become more readily apparent upon reference to the following description when taken in conjunction with the following drawings.

In accordance with the present invention, an antenna unit is disclosed which includes two antenna bodies with reception and transmitting means. The antenna bodies are movably arranged to each other and to the portable radio unit.

The present invention includes a first and a second antenna body with a first and a second end portion. The first antenna body has an array of antenna elements, e.g. patches, on a top surface to receive radio signals. The second antenna body has an array of antenna elements, e.g. patches, on a top surface to transmit radio signals. Said antenna bodies can be extended with extensions comprising arrays of patches. The beams from the arrays are electrically steerable. The second antenna body can either be inserted into or folded onto the first antenna body. The antenna unit can be folded onto the portable terminal in such a way that said first and second antenna bodies become parallel to the portable terminal and each other.

Advantages with the present invention are that the beams of the antenna unit are steerable, highly directional and that they increase the terminal antenna transmit and receive gain.

Other advantages are that the antenna unit diverts the radiated power from the user and that it can be made foldable or telescopic.

Another advantage is that the receiving and transmitting means of the antenna unit (the antenna aperture area) can be extendible into more than one direction.

Yet another advantage is that the antenna unit can establish a beam sufficiently sharp to select one of several satellites which can be viewed from the site of the portable radio unit.

BRIEF DESCRIPTION OF THE DRAWINGS

The invention will now be described in conjunction with the accompanying drawings in which.

DETAILED DESCRIPTION OF EMBODIMENTS

The present invention is an antenna unit for a portable radio unit, e.g. mobile phones, pagers, telex, electronic notebooks and communicators, capable of operating in a satellite communication mode.

Figure 1:
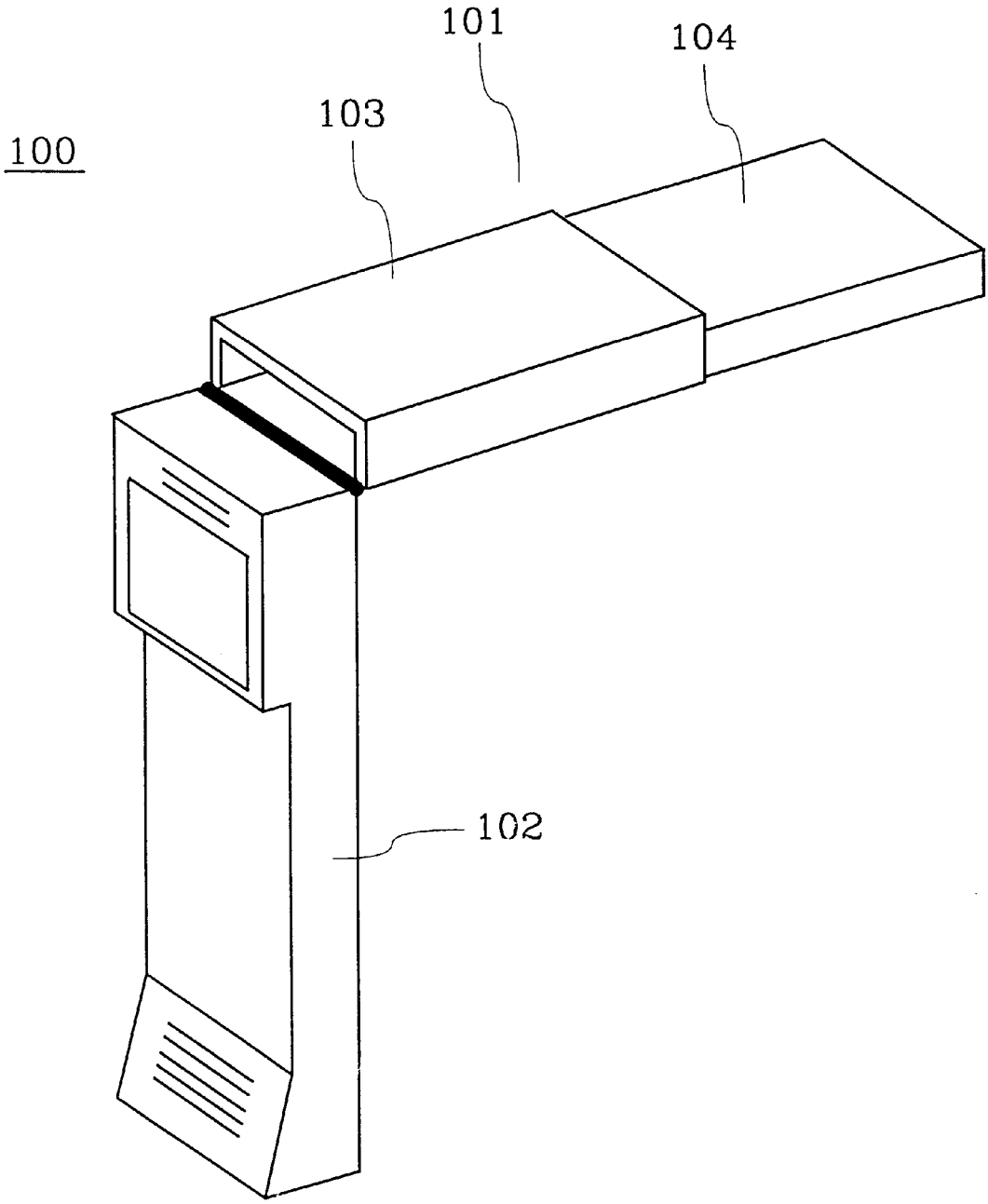
FIG. 1 is an overview of a portable radio unit.

FIG. 1 is an overview of a portable radio unit 100 including a terminal unit 102 and one embodiment of an antenna unit 101 according to the present invention. The antenna unit 101 comprises a first and a second antenna body 103, 104 respectively which are movably arranged to each other.

Figure 2A:
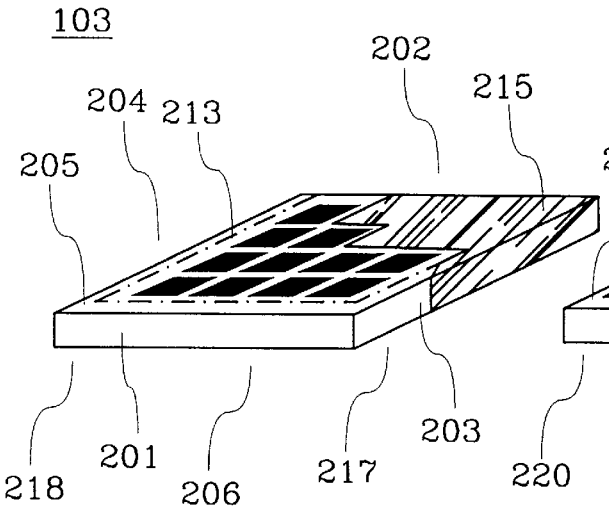
FIG. 2*a* is a perspective view of a first antenna body in accordance with the present invention.
Figure 2B:
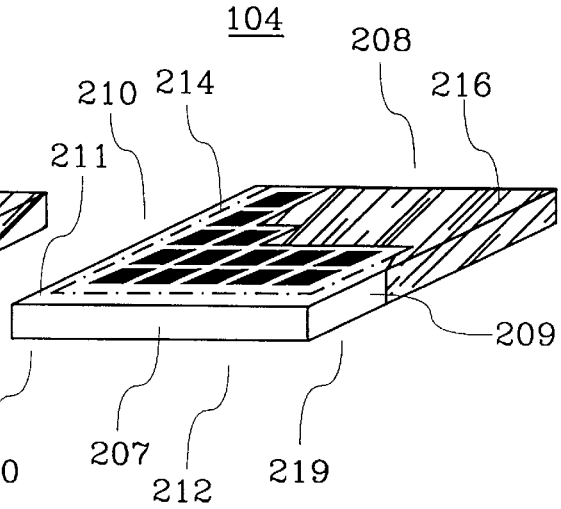
FIG. 2*b* is a perspective view of a second antenna body in accordance with the present invention.

FIGS. 2*a* and 2*b* are perspective views of the first and the second antenna body 103, 104 respectively. The antenna bodies 103 and 104 are rectangular shaped. According to FIG. 2*a* the first antenna body 103 has a first and a second end portion 201, 202 respectively, a first and a second side portion 203 and 204, a top and a bottom surface 205, 206 respectively. According to FIG. 2*b* the second antenna body 104 has a first and a second end portion 207, 208 respectively, a first and a second side portion 209 and 210, a top and a bottom surface 211, 212 respectively.

The second end portion 202, the second side portion 204 and the bottom surface 206 are hidden in FIG. 2*a*. The second end portion 208, the second side portion 210 and the bottom surface 212 are hidden in FIG. 2*b*.

The first antenna body 103 has an array of antenna elements 213, e.g. patches, on the top surface 205 to receive radio signals. The second antenna body 104 has an array of antenna elements 214, e.g. patches, on the top surface 211 to transmit radio signals. The patches can as an example be rectangular or circular in shape and they can as an example be placed in a rectangular or triangular grid. The size and number of patches on each of the two antenna bodies 103 and 104 differ due to different frequencies in the received and transmitted radio signals. Small patches for high frequencies and larger patches for lower frequencies. The arrays of patches 213 and 214 can electrically steer their radio beams by using known techniques.

Each of the antenna bodies 103 and 104 can be enclosed by a cover 215 and 216. FIGS. 2*a* and 2*b* show a part of each of said covers 215 and 216 in the right-hand corner of the respective antenna body 103 and 104, each of which are hiding a number of patches.

Figure 2C:
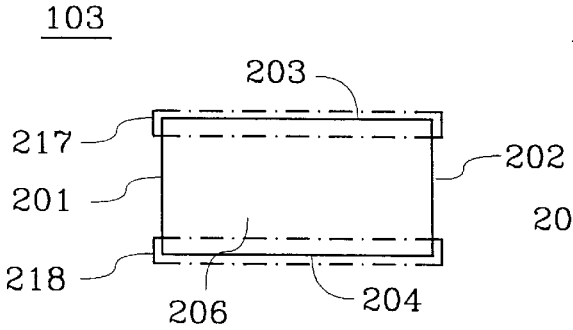
FIG. 2*c* is a bottom view of the first antenna body in FIG. 2*a*.

According to FIG. 2*c*, which shows a bottom view of the first antenna body 103 in FIG. 2*a*, the bottom surface 206 has a first and a second portion 217, 218 respectively, extending in a longitudinal direction next to the first and second side portion 203, 204 respectively.

Figure 2D:
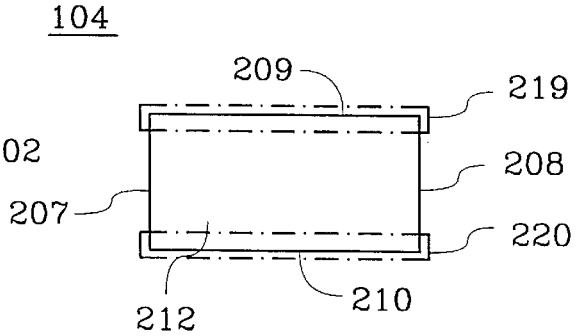
FIG. 2*d* is a bottom view of the second antenna body in FIG. 2*b*.

According to FIG. 2*d*, which shows a bottom view of the second antenna body 104 in FIG. 2*b*, the bottom surface 212 has a first and a second portion 219, 220 respectively, extending in a longitudinal direction next to the first and second side portion 209, 210 respectively.

Figure 3:
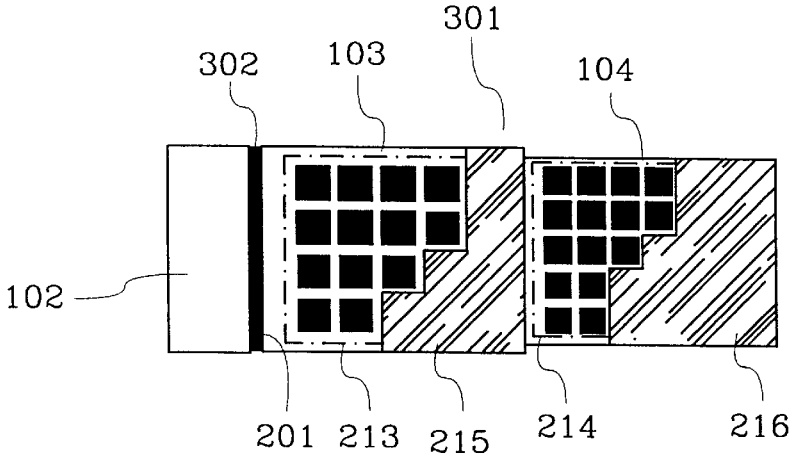
FIG. 3 is a top view of a first embodiment of an antenna unit in accordance with the present invention as attached to a terminal unit.

FIG. 3 is a top view of a first embodiment of an antenna unit 301 of the present invention as attached to the terminal unit 102 comprising the first and the second antenna bodies 103, 104 respectively. The antenna unit 301 is coupled to the terminal unit 102 by a first attachment, e.g. a hinge 302, arranged between the first antenna body 103 and the terminal unit 102.

The hinge 302 is attached to the first end portion 201 of the first antenna body 103 and to the terminal unit 102. The antenna arrays 213 and 214 are connected to circuits in the terminal 102 through the hinge 302.

The width of the second antenna body 104 is somewhat smaller than the width of the first antenna body 103.

The antenna bodies 103 and 104 are shaped so that the second antenna body 104 can be slidingly movable in relation to the first antenna body 103.

FIG. 3 shows a part of each of the covers 215 and 216, each of which are hiding a number of patches.

Figure 4:
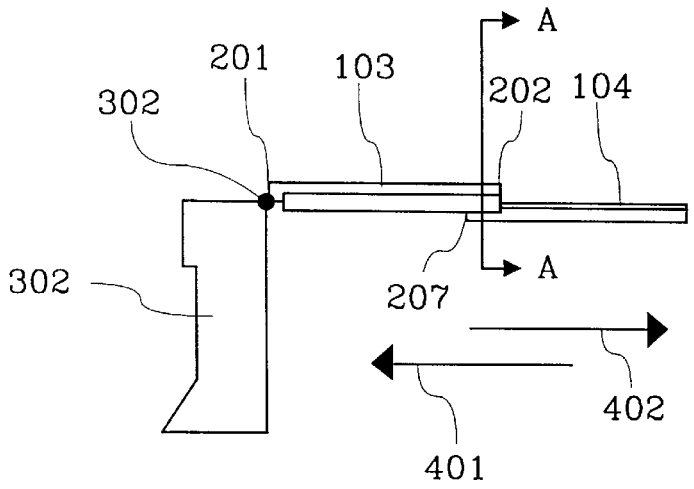
FIG. 4 is a schematically side view of the antenna unit and the terminal unit shown in FIG. 3.

FIG. 4 shows schematically that the second antenna body 104 can be pushed into and under the first antenna body 103, see arrow 401. The first end portion 207 of the second antenna body 104 is then slided from the second end portion 202 to the first end portion 201 of the first antenna body 103. The second, antenna body 104 can be fully inserted under the first antenna body 103, see FIG. 6*a*. The antenna unit 301 can receive radio signals with the first antenna body 103 independently of if the second antenna body 104 is fully, partially or not slided into and under the first antenna body 103.

According to FIG. 4, the second antenna body 104 is also arranged to be slidingly pushed out, see arrow 402, under the first antenna body 103. The second antenna body 104 is slided out from the second end portion 202 of the first antenna body 103.

Figure 5:
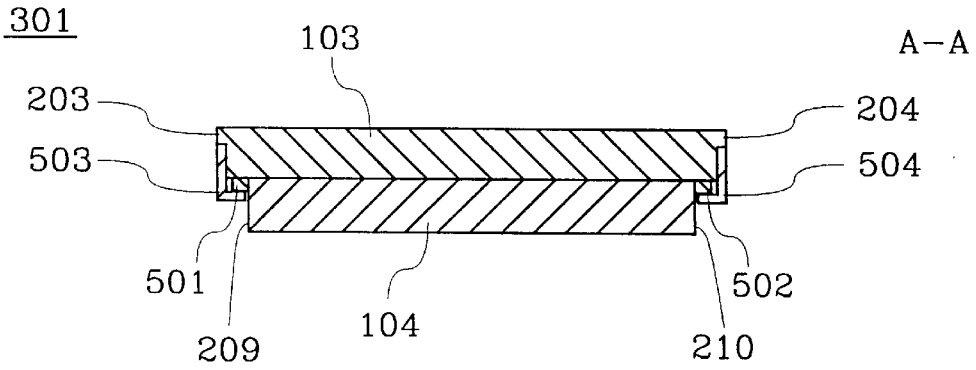
FIG. 5 is a cross-section of the antenna unit according to FIG. 4.

According to FIG. 5 which is a cross-section along line A—A, shown in FIG. 4, of the antenna unit 301, the second antenna body 104 has a guide 501 and 502 along each side portion 209 and 210. The guides 501 and 502 are inserted into a rail 503 and 504 attached to each of the two side portions 203 and 204 of the first antenna body 103.

Figure 6A:
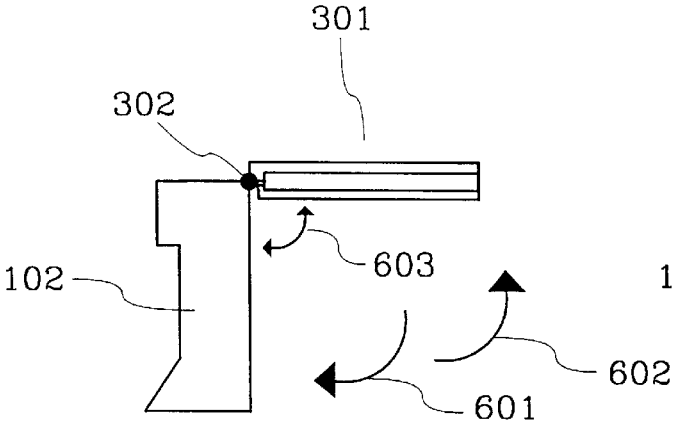
FIG. 6*a* is a schematically side view of the antenna unit, shown in FIG. 4, in a folded position and attached to the terminal unit.
Figure 6B:
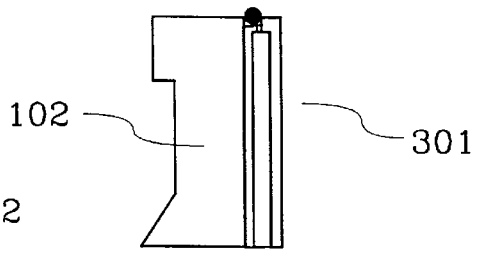
FIG. 6*b* is a schematically side view of the antenna unit, shown in FIG. 4, in a folded position and folded onto the terminal unit.

FIG. 6*a* shows schematically that the hinge 302 enables the antenna unit 301 to be folded onto the terminal unit 102, see arrow 601, and in such a way that the antenna unit 301 becomes parallel to the terminal unit 102, see FIG. 6*b*.

The hinge 302 also enables the antenna unit 301 to be unfolded from the terminal unit 102, see arrow 602 in FIG. 6*a*, in such a way that the antenna unit 301 can be positioned at a specified first angle 603, e.g. 90 degrees, between the terminal unit 102 and the antenna unit 301. The hinge 302 is arranged to enable the antenna unit 301 to maintain its position at the specified angle 603 when it is unfolded from the terminal unit 102.

The second antenna body 104 with the array of patches 214, see FIG. 3, to transmit radio signals is positioned in that part of the antenna unit 301 which is furthest away from the terminal unit 102 when the antenna unit 301 is unfolded. The positioning of the second antenna body 104 in combination with the fact that the beam from the array 214 is electrically steerable entails that the transmitted beam avoids to be scattered by the user of the terminal unit 102.

Each of the antenna bodies 103 and 104 can be extended with at least two extensions with an extra set of array of patches.

Figure 7:
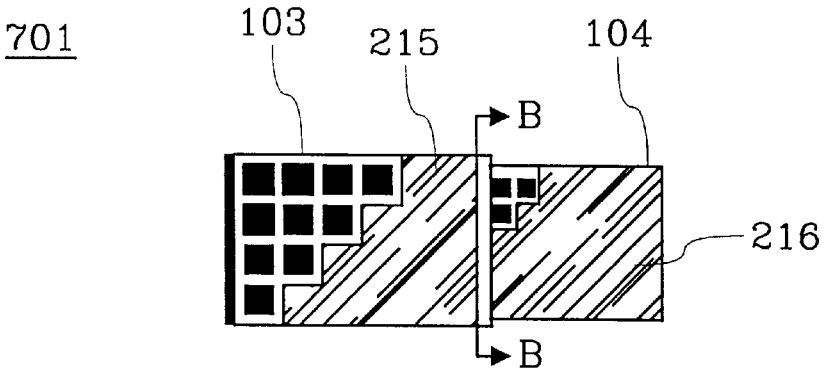
FIG. 7 is a top view of a second embodiment of an antenna unit in accordance with the present invention.

FIG. 7 is a top view of a second embodiment of an antenna unit 701 of the present invention comprising the first and the second antenna bodies 103, 104 respectively. The second embodiment is a further development of the first embodiment according to FIGS. 3–6*b*.

The second antenna body 104 is shown partially inserted into and under the first antenna body 103.

FIG. 7 shows a part of each of the covers 215 and 216, each of which are hiding a number of patches.

Figure 8:
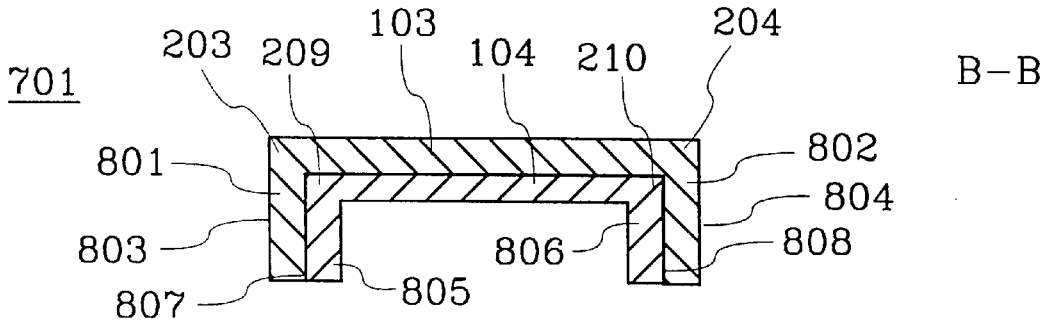
FIG. 8 is an example of a cross-section of the antenna unit according to FIG. 7.

FIG. 8 is a cross-section along line B—B of the antenna unit 701 shown in FIG. 7. A first and a second extension 801, 802 respectively are integrated with the side portions 203 and 204 of the first antenna body 103 creating a conformal u-shaped antenna body 103. Each of the extensions 801 and 802 has an outer surface 803 and 804 in opposite directions of each other with an array of patches 901 and 902, not shown here but 901 is illustrated in FIG. 9.

The second antenna body 104 of the antenna unit 701 has also a first and a second extension 805, 806 respectively. These extensions 805 and 806 are integrated with the side portions 209 and 210 of the second antenna body 104 creating a conformal u-shaped antenna body 104. Each of the extensions 805 and 806 has an outer surface 807 and 808 in opposite directions of each other with an array of patches 903 and 904, not shown here but 903 is illustrated in FIG. 9.

Figure 9:
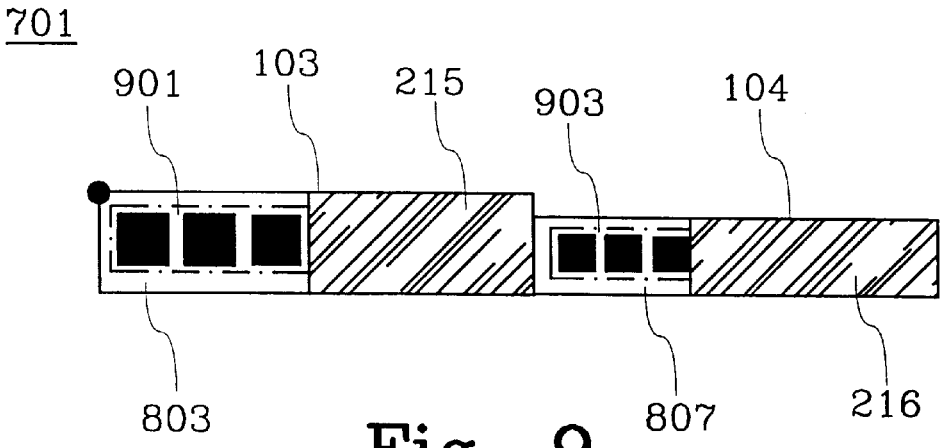
FIG. 9 is a side view of the antenna unit shown in FIG. 7.

FIG. 9 is a side view of the antenna unit 701 with the outer surface 803 of the first antenna body 103 and the outer surface 807 of the second antenna body 104. FIG. 9 shows the arrays of patches 901 and 903 on the outer surfaces 803 and 807. The arrays of patches 902 and 904, hidden in FIG. 9, are provided on the opposite outer surfaces 804 and 808, hidden in FIG. 9, on the extensions 802 and 806.

FIG. 9 also shows a part of each of the covers 215 and 216, each of which are hiding a number of patches.

Figure 10:
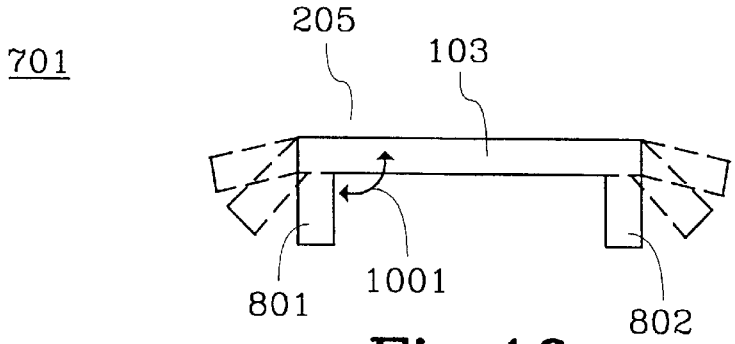
FIG. 10 is a schematically end view of the antenna unit shown in FIG. 7.

The extensions 801 and 802 of the first antenna body 103 are arranged in a specified second angle 1001, see FIG. 10, related to the top surface 205 of the first antenna body 103.

The extensions 805 and 806 of the second antenna body 104 are arranged in a specified third angle 1002, not shown in any figures, related to the front surface 211 of the second antenna body 104.

The second angle 1001 and the third angle 1002 have preferably the same value, e.g. 90, 120 or 180 degrees, but a small difference between them is also possible. The extensions 805 and 806 of the second antenna body 104 must be able to be inserted between the extensions 801 and 802 of the first antenna body 103.

Figure 11A:
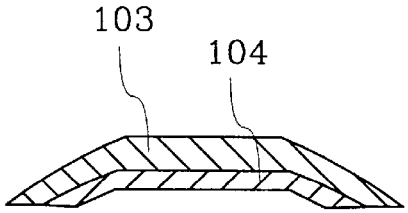
FIG. 11*a* is another example of a cross-section of the antenna unit shown in FIG. 7.
Figure 11B:
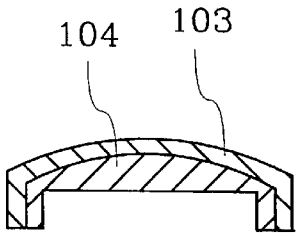
FIG. 11*b* is yet another example of a cross-section of the antenna unit shown in FIG. 7.

FIGS. 11*a* and 11*b* are cross-sections of two different designs of the antenna unit 701 with different first and second angles.

Figure 12:
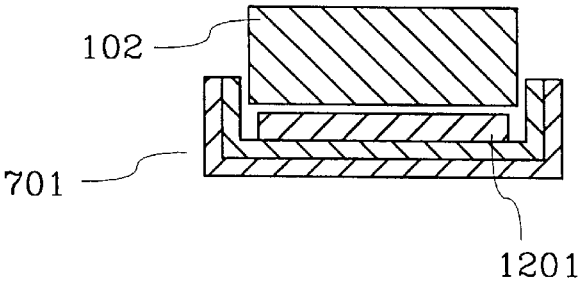
FIG. 12 is a cross-section of the antenna unit shown in FIG. 7, the terminal unit and a battery unit.

FIG. 12 is a cross-section of the antenna unit 701, the terminal unit 102 and a battery unit 1201, when the antenna unit 701 is folded against the terminal unit 102 as in FIG. 6*b*. The battery unit 1201 is attached to the bottom surface 212 and between the extensions 805 and 806 of the second antenna body 104. The battery unit 1201 is encompassed by the antenna unit 701 and the terminal unit 102 when the antenna unit 701 is folded against the terminal unit 102.

Figure 13A:
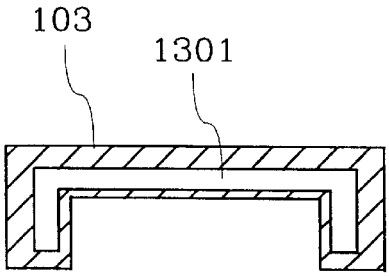
FIG. 13*a* is a cross-section of another example of a first antenna body in the second embodiment of the antenna unit in accordance with the present invention.

According to FIG. 13*a*, which is a cross-section of the first antenna body 103 of the antenna unit 701, the first antenna body 103 can also be arranged to form a cavity 1301 in which the second antenna body 104 can be inserted and pulled out (telescopic). The first end portion 207 of the second antenna body 104 is inserted into the cavity 1301 of the first antenna body 103 through the second end portion 202 of the first antenna body 103. The second antenna body 104 is completely covered by the first antenna body 103 when it is fully inserted into the cavity 1301 of the first antenna body 103.

Figure 13B:
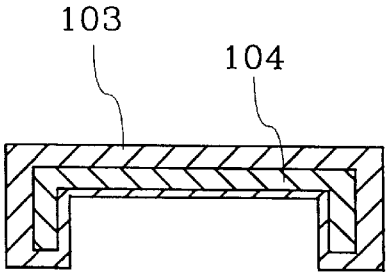
FIG. 13*b* is a cross-section of another example of the second embodiment of the antenna unit in accordance with the present invention.

FIG. 13*b* is a cross-section of the first and second antenna bodies 103, 104 respectively when the second antenna body 104 is inserted into the first antenna body 103.

The antenna unit 701 can receive radio signals with the first antenna body 103 independently of if the second antenna body 104 is fully, partially or not inserted into the first antenna body 103.

Figure 14:
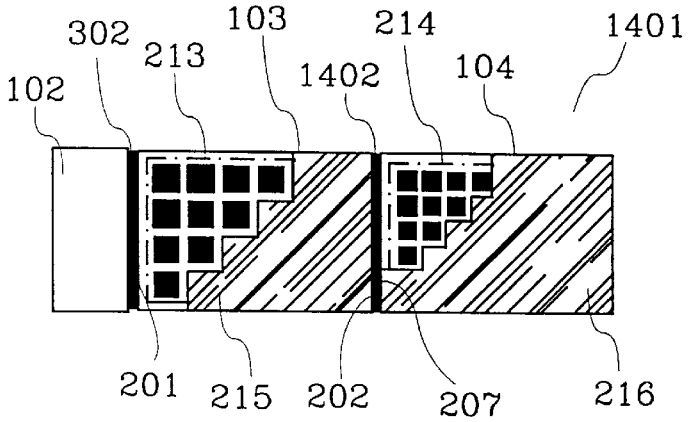
FIG. 14 is a top view of a third embodiment of an antenna unit in accordance with the present invention.

FIG. 14 is a top view of a third embodiment of an antenna unit 1401 of the present invention as attached to the terminal unit 102 comprising the first and the second antenna bodies 103, 104 respectively. The antenna unit 1401 is coupled to the terminal unit 102 by the hinge 302 (the hinge 302 is now referred to as the first hinge).

The first hinge 302 is attached to the first end portion 201 of the first antenna body 103 and to the terminal unit 102.

A second attachment, e.g. a second hinge 1402, is attached to the second end portion 202 of the first antenna body 103 and to the first end portion 207 of the second antenna body 104.

FIG. 14 shows a part of each of the covers 215 and 216, each of which are hiding a number of patches.

Figure 15:
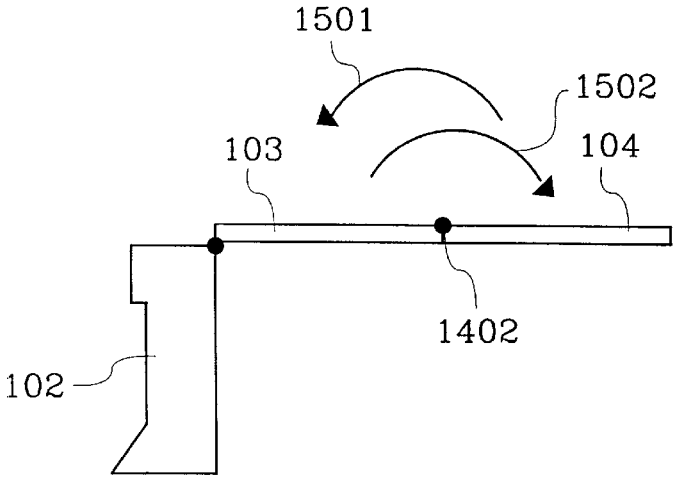
FIG. 15 is a schematically side view of the antenna unit a nd the terminal unit shown in FIG. 14.
Figure 16A:
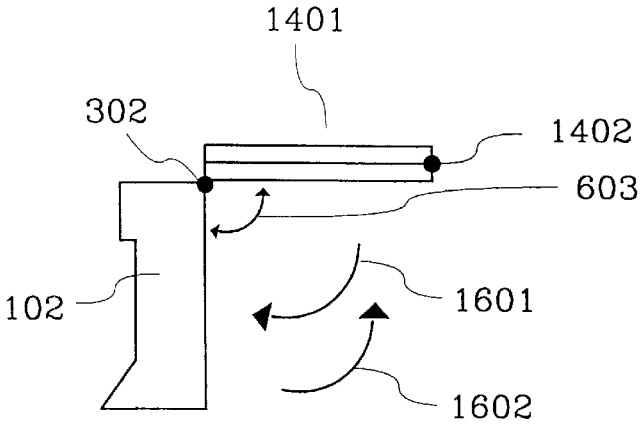
FIG. 16*a* is a schematically side view of the antenna unit, shown in FIG. 14, in a folded position and attached to the terminal unit.

FIG. 15 shows schematically that the second hinge 1402 enables the second antenna body 104 to be folded onto the first antenna body 103, see arrow 1501, in such a way that the top surface 211, see FIG. 2*b*, of the second antenna body 104 faces the top surface 205 of the first antenna body 103 in a closed position, see FIG. 16*a*.

The second hinge 1402 also enables the second antenna body 104 to be unfolded from the first antenna body 103, see arrow 1502 in FIG. 15, and to maintain its position in such a way that a normal vector of the second antenna body 104 faces the same direction as a normal vector of the first antenna body 103.

Figure 16B:
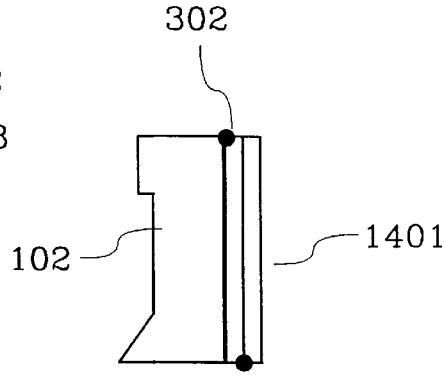
FIG. 16*b* is a schematically side view of the antenna unit, shown in FIG. 14, in a folded position and folded onto the terminal unit.

According to FIG. 16*a*, the first hinge 302 enables the antenna unit 1401 to be folded onto the terminal unit 102, see arrow 1601, in such a way that the antenna unit 1401 becomes parallel to the terminal unit 102, see FIG. 16*b*.

The first hinge 302 also enables the antenna unit 1401 to be unfolded from the terminal unit 102, see arrow 1602, in such a way that the antenna unit 1401 can be positioned at the specified first angle 603 between the terminal unit 102 and the antenna unit 1401. The first hinge 302 is arranged to enable the antenna unit 1401 to maintain its position at the specified first angle 603 when it is unfolded from the terminal unit 102.

The array of patches 213 on the first antenna body 103 is connected to circuits in the terminal unit 102 through the first hinge 302 and the array of patches 214 on the second antenna body 104 is connected to circuits in the terminal unit 102 through both the second and the first hinge 1402, 302 respectively.

The array of patches 214 for transmitting is positioned in the second antenna body 104 which is furthest away from the terminal unit 102 when the antenna unit is unfolded.

Each of the antenna bodies 103 and 104 can be extended with at least two extensions with an extra set of array of patches.

Figure 17:
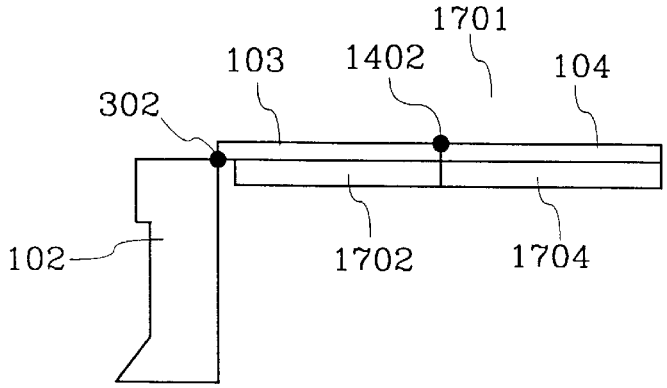
FIG. 17 is a schematically side view of a forth embodiment of an antenna unit in accordance with the present invention attached to the terminal unit.

FIG. 17 shows schematically a side view of a forth embodiment of an antenna unit 1701 of the present invention as attached to the terminal unit 102, comprising the first and the second antenna bodies 103, 104 respectively. The forth embodiment is a further development of the third embodiment according to FIGS. 14–16*b*.

A first and a third extension 1702 and 1704 are arranged on and along the first portion 217 and 219, see FIGS. 2*a*–*d*, of the bottom surfaces 206 and 212 on the antenna bodies 103, 104 respectively, next to the side portions 203 and 209.

A second and a forth extension 1703 and 1705, hidden in FIG. 17, are arranged on and along the second portion 218 and 220 of the bottom surfaces 206 and 212 on the antenna bodies 103, 104 respectively, next to the side portions 204 and 210. The extensions 1702 and 1703 are attached to the first antenna body 103 by two attachments, e.g. hinges 1706 and 1707, hidden in FIG. 17 but shown in FIG. 22.

Figure 18A:
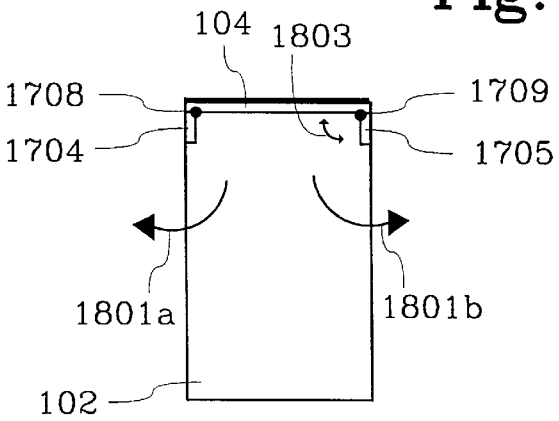
FIG. 18*a* is a rear view of the antenna and terminal unit shown in FIG. 17.
Figure 22:
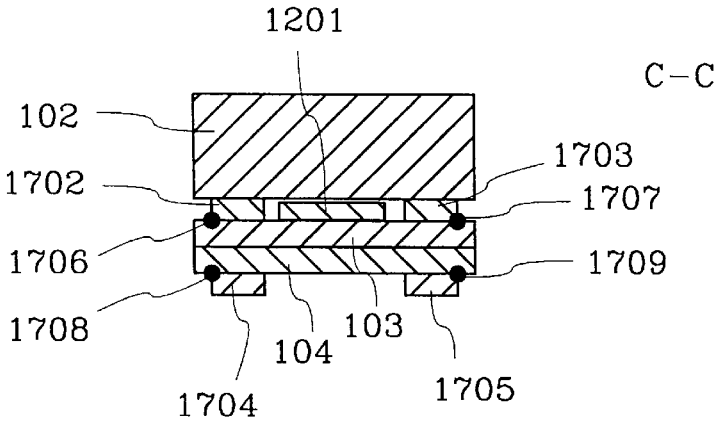
FIG. 22 is a cross-section of the antenna unit shown in FIG. 17, the terminal unit and a battery unit.

The extensions 1704 and 1705 are attached to the second antenna body 104 by two attachments, e.g. hinges 1708 and 1709, see FIGS. 18*a* and 22.

Figure 18B:
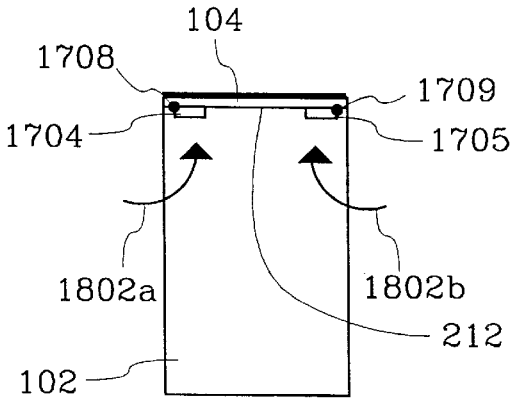
FIG. 18*b* is a rear view of the antenna and terminal unit shown in FIG. 17, with folded extensions.

FIGS. 18*a*–*b* are rear views of the terminal unit 102 including the antenna unit 1701 when unfolded. The figures show the third and forth extensions 1704 and 1705, attached to the second antenna body 104 by the hinges 1708 and 1709.

According to FIG. 18*a*, the hinges 1708 and 1709 enable the extensions 1704 and 1705 to be unfolded, see arrows 1801*a*–*b*, in such a way that they can be positioned at a specified forth angle 1803, e.g. 90 degrees, between the second antenna body 104 and each of the extensions 1704 and 1705, creating a conformal u-shaped antenna body 104.

According to FIG. 18*b*, the hinges 1708 and 1709 enable the extensions 1704 and 1705 to be folded against the bottom surface 212 of the second antenna body 104, see arrows 1802*a*–*b*.

The first and second extension 1702 and 1703, attached to the first antenna body 103 by the hinges 1706 and 1707, are arranged to be folded against the bottom surface 206 of the first antenna body 103 and to be unfolded in the same way as the third and forth extensions 1704 and 1705 of the second antenna body 104. This is not shown with a figure.

Figure 19:
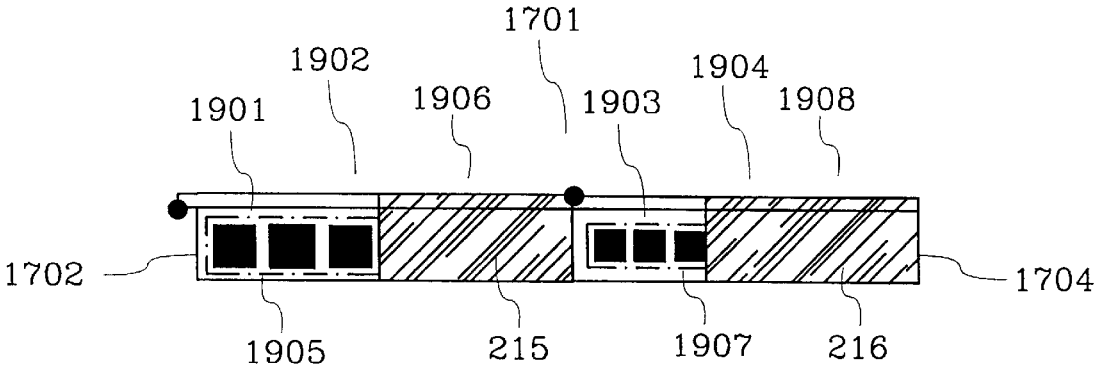
FIG. 19 is a side view of the antenna unit shown in FIG. 17.

According to FIG. 19, which is a side view of the antenna unit 1701, the extensions 1702 and 1704 have outer surfaces 1901 and 1903 with arrays of patches 1905 and 1907. The extension 1703, hidden in FIG. 19, on the opposite side of the antenna unit 1701 has an outer surface 1902 facing the opposite direction of the outer surface 1901 with an array of patches 1906. The extension 1705, hidden in FIG. 19, on the opposite side of the antenna unit 1701 has also an outer surface 1904 facing the opposite direction of the outer surface 1903 with an array of patches 1908.

FIG. 19 shows a part of each of the covers 215 and 216, each of which are hiding a number of patches.

Figure 20:
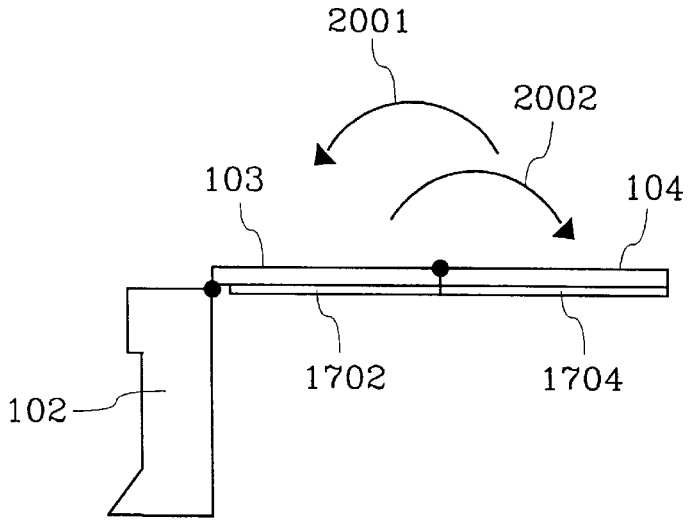
FIG. 20 is a schematically side view of the antenna and terminal unit, shown in FIG. 17, with folded extensions.
Figure 21A:
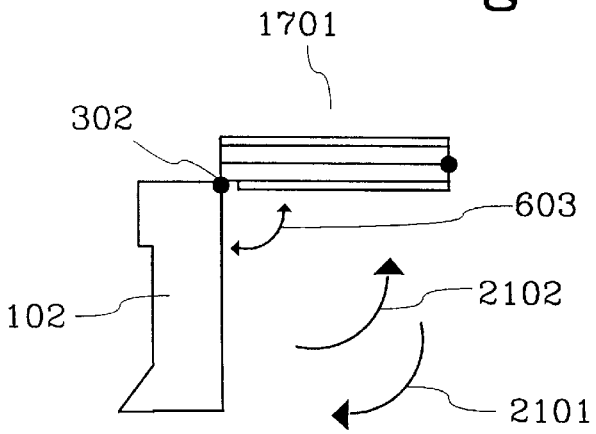
FIG. 21*a* is a schematically side view of the antenna unit, shown in FIG. 20, in a folded position and attached to the terminal unit.

According to FIG. 20, the second antenna body 104 can be folded onto the first antenna body 103, see arrow 2001, in the same way as the third embodiment of the antenna unit, see FIG. 15, to a closed position, see FIG. 21*a*.

The second antenna body 104 can be unfolded from the first antenna body 103, see arrow 2002 in FIG. 20, and maintain its position in the same way as the third embodiment of the antenna unit, see FIG. 15.

Figure 21B:
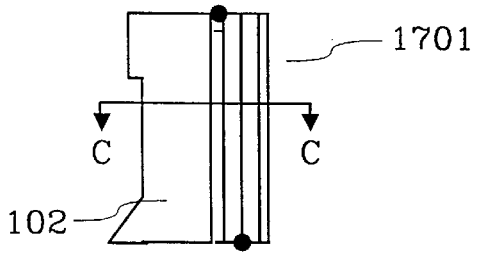
FIG. 21*b* is a schematically side view of the antenna unit, shown in FIG. 20, in a folded position and folded onto the terminal unit.

According to FIGS. 21*a*–*b*, the first hinge 302 enables the antenna unit 1701 to be folded onto the terminal unit 102, see arrow 2101, in such a way that the antenna unit 1701 becomes parallel to the terminal unit 102, see FIG. 21*b*.

The first hinge 302 also enables the antenna unit 1701 to be unfolded from the terminal unit 102, see arrow 2102 in FIG. 21*a*, in such a way that the antenna unit 1701 can be positioned at the specified first angle 603 between the terminal unit 102 and the antenna unit 1701. The first hinge 302 is arranged to enable the antenna unit 1701 to maintain its position at the specified first angle 603 when it is unfolded from the terminal unit 102.

FIG. 22 is a cross-section through line C—C, shown in FIG. 21*b*, of the antenna unit 1701, the terminal unit 102 and the battery unit 1201, when the antenna unit 1701 is folded against the terminal unit 102. The battery unit 1201 is attached to the bottom surface 206 and between the folded extensions 1702 and 1703 of the first antenna body 103. The battery unit 1201 is encompassed by the antenna unit 1701 and the terminal unit 102 when the antenna unit 1701 is folded against the terminal unit 102.

Figure 23:
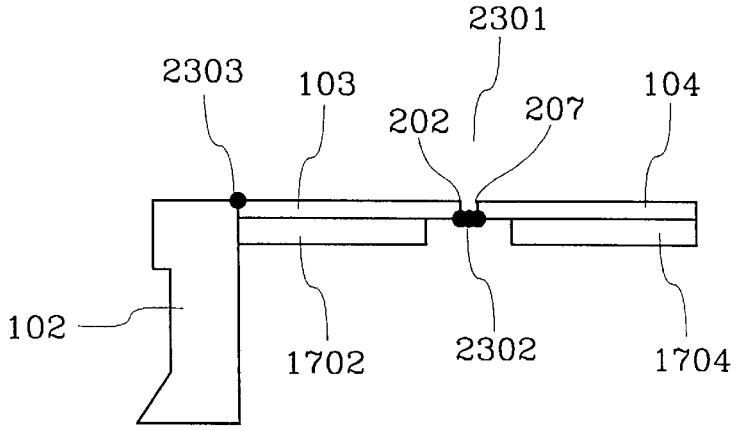
FIG. 23 is a schematically side view of a fifth embodiment of an antenna unit in accordance with the present invention attached to the terminal unit.

FIG. 23 shows schematically a side view of a fifth embodiment of an antenna unit 2301 of the present invention as attached to the terminal unit 102, comprising the first and the second antenna bodies 103, 104 respectively. The fifth embodiment is a further development of the forth embodiment according to FIGS. 17–22.

A hinge 2302 is attached to the second end portion 202 of the first antenna body 103 and to the first end portion 207 of the second antenna body 104.

The first antenna body 103 is coupled to the terminal unit 102 with a different first attachment 2303 compared to the previous embodiment of the antenna unit 1701.

The first attachment 2303 is a ball-and-socket joint 2303 or a similar device allowing movement in all directions.

The joint 2303 is attached to the first end portion 201 of the first antenna body 103 and to the terminal unit 102.

The first end portion 201 is hidden in FIG. 23.

Figure 24A:
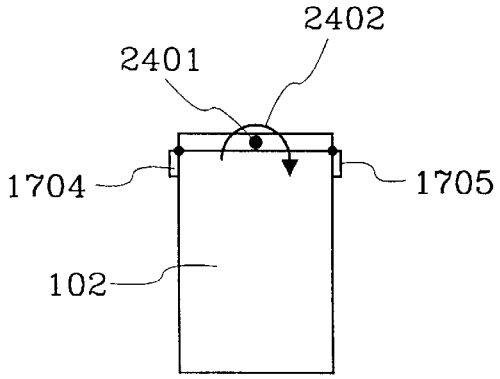
FIG. 24*a* is a rear view of the antenna and terminal unit shown in FIG. 23.
Figure 24B:
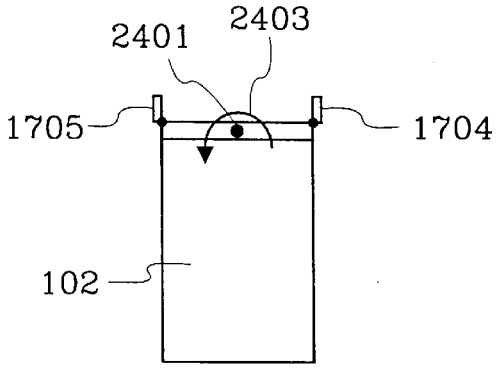
FIG. 24*b* is a rear view of the antenna and terminal unit, shown in FIG. 23, with the antenna unit turned 180 degrees.

According to FIGS. 24*a*–*b*, which are rear views of the terminal unit 102 including the unfolded antenna unit 2301, the joint 2303 enables the antenna unit 2301 to be turned 180 degrees along its longitudinal axis 2401, see arrows 2402 and 2403.

Figure 25:
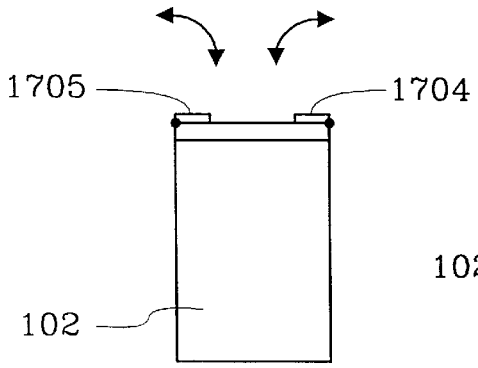
FIG. 25 is a rear view of the antenna and terminal unit, shown in FIG. 23, with folded extensions.

FIG. 25, which is a rear view of the terminal unit 102 including the unfolded antenna unit 2301, shows the extensions 1702, 1703, 1704, 1705 respectively, in a folded position against the bottom surfaces 206, 212 respectively. The extensions 1702 and 1703 are hidden behind the extensions 1704 and 1705 in FIG. 25.

Figure 26:
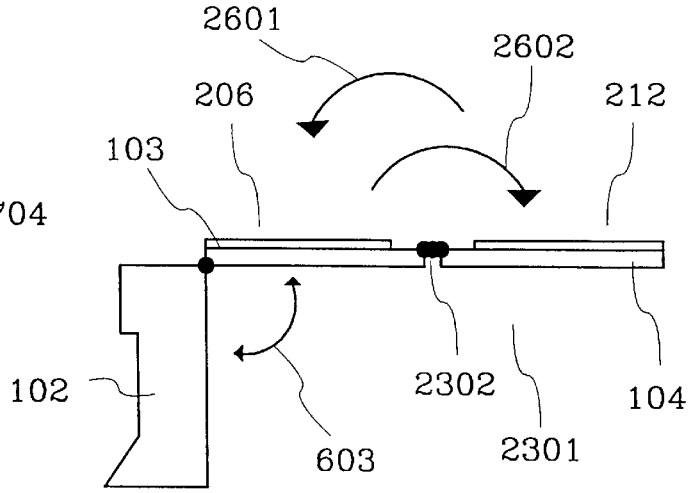
FIG. 26 is a schematically side view of the antenna and terminal unit, shown in FIG. 23, with folded extensions.
Figure 27A:
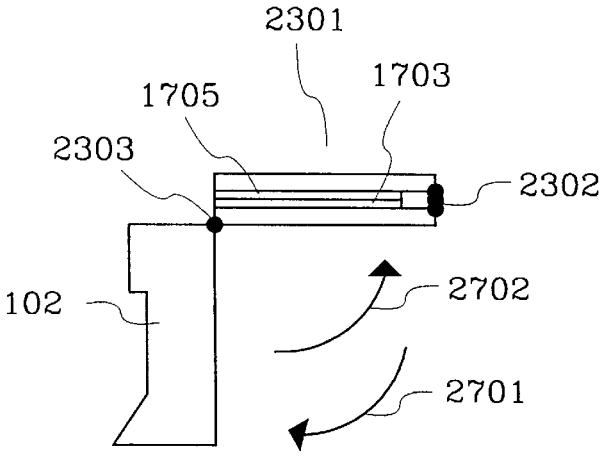
FIG. 27*a* is a schematically side view of the antenna unit, shown in FIG. 26, in a folded position and attached to the terminal unit.

FIG. 26 shows schematically that the hinge 2302 enables the second antenna body 104 to be folded onto the first antenna body 103, see arrow 2601, in such a way that the bottom surface 212 of the second antenna body 104 faces the bottom surface 206 of the first antenna body 103 in a closed position, see FIG. 27*a*.

According to FIG. 27*a*, the hinge 2302 enables the unfolded extensions 1702, 1703, 1704, 1705 respectively, attached to the first and second antenna bodies 103, 104 respectively, to be positioned between the bottom surfaces 206 and 212 in the closed position. The extensions 1702 and 1704 are hidden in FIG. 27*a*.

The hinge 2302 also enables the second antenna body 104 to be unfolded from the first antenna body 103, see arrow 2602 in FIG. 26, and to maintain its position in such a way that the normal vector of the second antenna body 104 becomes parallel to the normal vector of the first antenna body 103.

Figure 27B:
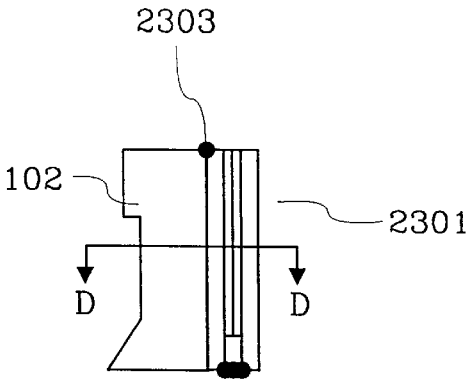
FIG. 27*b* is a schematically side view of the antenna unit, shown in FIG. 26, in a folded position and folded onto the terminal unit.

According to FIGS. 27*a–b*, the joint 2303 also enables the antenna unit 2301 to be folded onto the terminal unit 102, see arrow 2701, in such a way that the antenna unit 2301 becomes parallel to the terminal unit 102, see FIG. 27*b*.

The joint 2303 also enables the antenna unit 2301 to be unfolded from the terminal unit 102, see arrow 2702, in such a way that the antenna unit 2301 can be positioned at the specified first angle 603, see FIG. 26, between the terminal unit 102 and the antenna unit 2301. The joint 2303 is arranged to enable the antenna unit 2301 to maintain its position at the specified first angle 603 when it is unfolded from the terminal unit 102.

Figure 28:
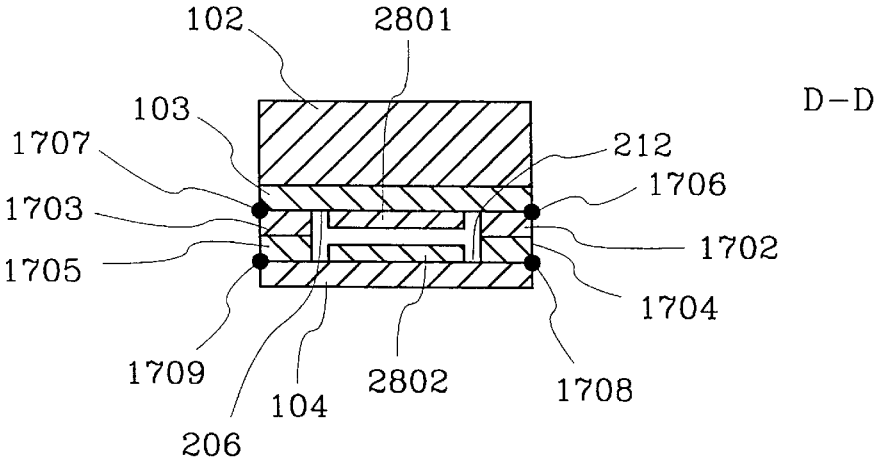
FIG. 28 is a cross-section of the antenna unit shown in FIG. 17, the terminal unit and two battery units.

FIG. 28 is a cross-section through line D—D, shown in FIG. 27*b*, of the antenna unit 2301, the terminal unit 102 and two battery units 2801, 2802 respectively, when the antenna unit 2301 is folded against the terminal unit 102. The battery unit 2801 is attached to the bottom surface 206 and between the folded extensions 1702 and 1703 of the first antenna body 103. The battery unit 2802 is attached to the bottom surface 212 and between the folded extensions 1704 and 1705 of the second antenna body 104. The battery units 2801 and 2802 are encompassed by the antenna bodies 103, 104 respectively and the folded extensions 1702, 1703, 1704, 1705 respectively when the antenna unit 2301 is folded.

Figure 29:
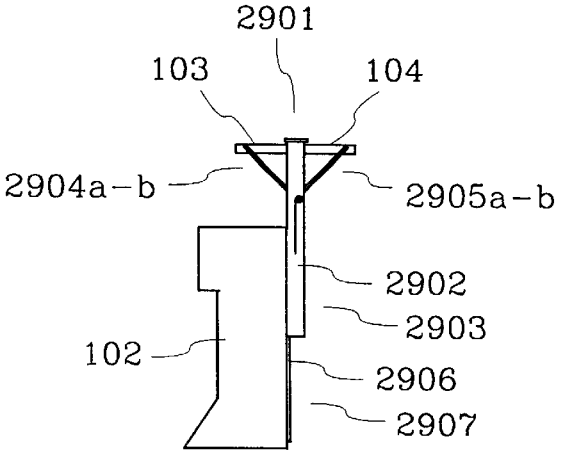
FIG. 29 is a schematically side view of a sixth embodiment of an antenna unit in accordance with the present invention attached to the terminal unit.

FIG. 29 shows schematically a side view of a sixth embodiment of an antenna unit 2901 of the present invention as attached to the terminal unit 102, comprising the first and the second antenna bodies, 103, 104 respectively.

The antenna bodies 103, 104 are coupled to the terminal unit 102 by a first and a second guide 2902, 2903 respectively.

The first antenna body 103 is supported by a first pair of antenna supports 2904*a–b*. The antenna support 2904*a* is arranged between the first antenna body 103 and the first guide 2902.

The antenna support 2904*b* is arranged between the first antenna body 103 and the second guide 2903.

The second antenna body 104 is supported by a second pair of antenna supports 2905*a–b*. The antenna support 2905*a* is arranged between the second antenna body 104 and the first guide 2902.

The antenna support 2905*b* is arranged between the second antenna body 104 and the second guide 2903.

The guides 2902, 2903 are movably attached to a first and a second rail 2906, 2907 respectively. The first and the second rail 2906, 2907 respectively are attached to and along the back of the terminal unit 102.

Figure 30:
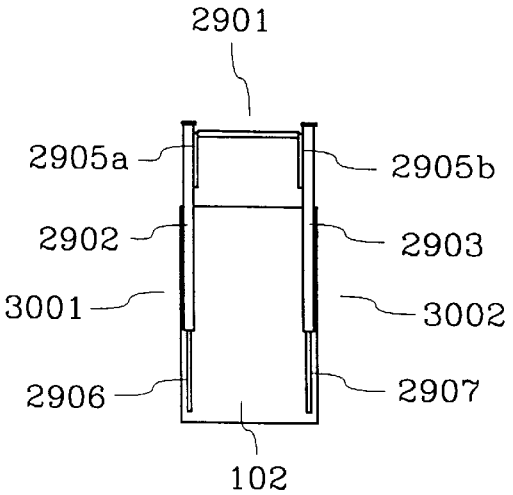
FIG. 30 is a rear view of the antenna and terminal unit shown in FIG. 29.

The second guide 2903, the second rail 2907 and the antenna supports 2904*b* and 2905*b* are hidden in FIG. 29 but shown in FIG. 30.

The first and second antenna body 103, 104 respectively comprises the first and second antenna arrays 213 and 214 as in the previous embodiments of the invention.

FIG. 30 shows schematically a rear view of the terminal unit 102 and the antenna unit 2901 with the first and second guide 2902, 2903 respectively and the first and second rail 2906, 2907 respectively.

The first rail 2906 is attached to and along a first side 3001 of the back of the terminal unit 102. The second rail 2907 is attached to and along a second side 3002 of the back of the terminal unit 102.

The width of the first and second antenna bodies 103,104 respectively are somewhat smaller than in the previous embodiments.

Figure 31:
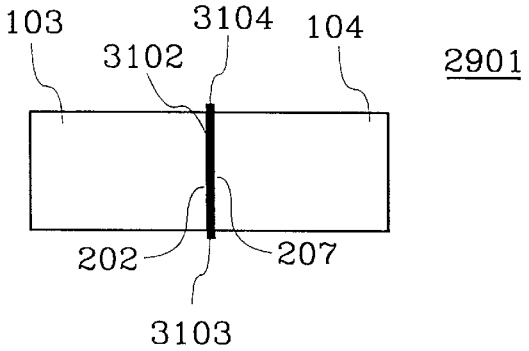
FIG. 31 is a schematically top view of the antenna unit shown in FIG. 29.

According to FIG. 31, which is a schematically top view of the antenna unit 2901, a hinge 3102 is attached to the second end portion 202 of the first antenna body 103 and to the first end portion 207 of the second antenna body 104. The hinge 3102 comprises a first and a second end portion 3103, 3104 respectively.

The hinge 3102 enables the antenna bodies 103 and 104 to be folded together with their bottom surfaces 206 and 212, see FIGS. 2*a–d*, facing each other.

The first end portion 3103 of the hinge 3102 is attached to the first guide 2902 and the second end portion 3104 of the hinge 3102 is attached to the second guide 2903.

Figure 32:
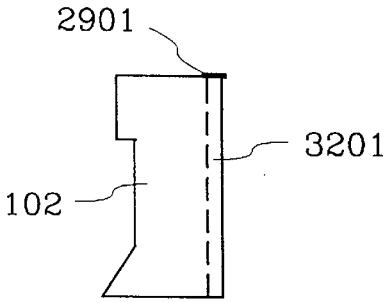
FIG. 32 is a schematically side view of the antenna and terminal unit, shown in FIG. 29, with the antenna unit in a folded position.

According to FIG. 32, the antenna unit 2901 and the guides 2902, 2903 respectively are arranged in a pocket 3201 at the back of the terminal unit 102 when the antenna unit 2901 is folded.

Each of the antenna supports 2904*a–b*, 2905*a–b* respectively comprises a first and a second end portion, not shown in any figure.

The first end portions of the antenna supports 2904*a–b* are attached to the first antenna body 103 and the first end portions of the antenna supports 2905*a–b* are attached to the second antenna body 104.

Figure 33A:
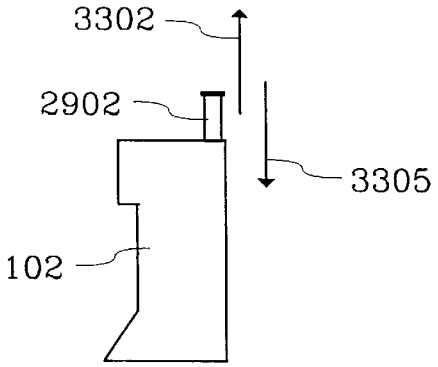
FIG. 33*a* is a schematically side view of the antenna and terminal unit, shown in FIG. 29 with the antenna unit about to be pulled out.
Figure 33B:
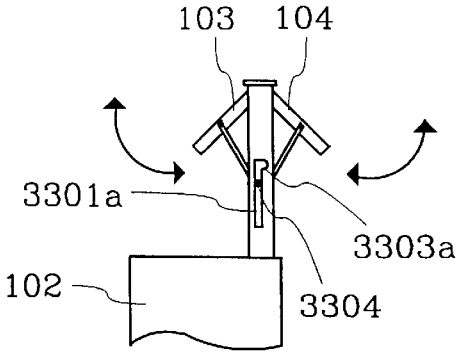
FIG. 33*b* is a schematically side view of the antenna and terminal unit, shown in FIG. 29, with the antenna unit about to be unfolded.

According to FIG. 33*b* the second end portion of the antenna support 2904*a* and the second end portion of the antenna support 2905*a* are attached to a first knob 3304. The second end portion of the antenna support 2904*b* and the second end portion of the antenna support 2905*b* are attached to a second knob 3305, hidden in FIG. 33*b*.

The first guide 2902 comprises a slot 3301*a* in which the first knob 3304 is inserted and the second guide 2902 comprises a slot 3301*b* in which the second knob 3305 is inserted. The slot 3301*b* is hidden in FIG. 33*b*.

The antenna supports 2904*a–b* and 2905*a–b* with their knobs 3304 and 3305 are arranged to be moved up and down along the guides 2902 and 2903 to unfold and fold the antenna bodies 103 and 104.

The antenna unit 2901 is arranged to be moved out of the pocket 3201 by moving the guides 2902 and 2903 upwards along the rails 2906, 2907 respectively, see arrow 3302 in FIG. 33*a*. The guides are arranged to be locked in a specified position which allows the antenna bodies 103, 104 respectively to be unfolded and deployed, see FIG. 33*b*.

The knobs 3304 and 3305 are arranged to be moved upwards along the slots 3301*a–b* until they snap into a stop pocket 3303*a–b* in each of the guides 2902, 2903 respectively to keep the antenna unit 2901 in an operational position (unfolded and deployed).

The antenna unit 2901 is also arranged to be folded and then moved down into the pocket 3201 at the back of the terminal unit 102, see arrow 3305 in FIG. 33*a*.

Figure 34:
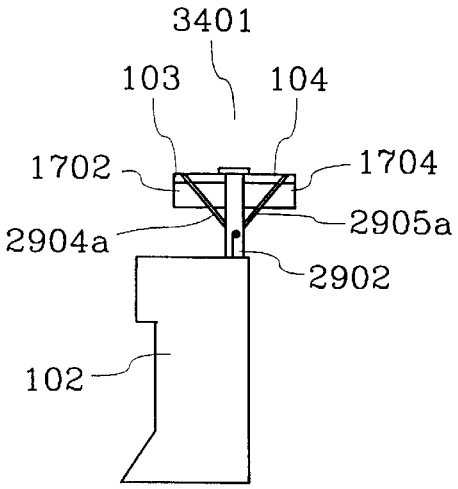
FIG. 34 is a schematically side view of a seventh embodiment of an antenna unit in accordance with the present invention attached to the terminal unit.

FIG. 34 shows schematically a side view of a seventh embodiment of an antenna unit 3401 of the present invention as attached to the terminal unit 102, comprising the first and the second antenna bodies 103, 104 respectively. The seventh embodiment is a further development of the sixth embodiment according to FIGS. 29–33*b*.

As in the forth and fifth embodiment the first and the third extension 1702 and 1704 are arranged on the first portions

217, 219 respectively of the bottom surfaces 206, 212 respectively on the first and second antenna body 103, 104 respectively, next to the side portions 203 and 209, see FIGS. 2*a–d*.

Figure 35:
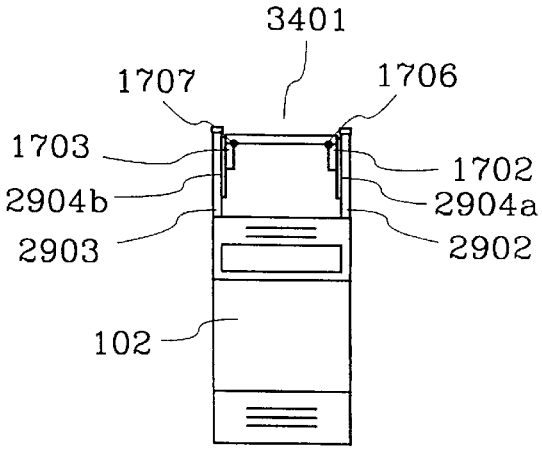
FIG. 35 is a front view of the antenna and terminal unit, shown in FIG. 34.

The second and the forth extension 1703 and 1705, hidden in FIG. 34, are arranged on the second portions 218 and 220 of the bottom surfaces 206 and 212, see FIGS. 2*a–d*, on the first and second antenna body 103, 104 respectively, next to the side portions 204 and 210 on the opposite side of the antenna unit 3401. The extensions 1702 and 1703 are attached to the first antenna body 103 by the hinges 1706 and 1707 as in the forth and fifth embodiment of the invention. The hinges 1706 and 1707 are hidden in FIG. 34 but shown in FIG. 35.

The extensions 1704 and 1705 are attached to the second antenna body 104 by the hinges 1708 and 1709 as in the forth and fifth embodiment of the invention. The hinges 1708 and 1709 are hidden in FIG. 34.

The extensions 1702–1705 can be folded and unfolded in the same way as in the forth and fifth embodiment of the invention.

The extensions 1702–1705 comprises the antenna arrays 1905–1908 as in the forth and fifth embodiment of the invention.

The first pair of antenna supports 2904*a–b* and the second pair of antenna supports 2905*a–b* are preferably of a material with a low dielectric constant.

Figure 36:
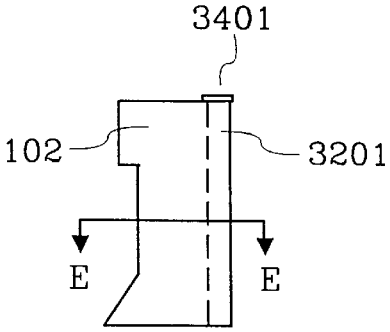
FIG. 36 a schematically side view of the antenna and terminal unit, shown in FIG. 34.

FIG. 36 shows schematically a side view of the terminal unit 102 with the antenna unit 3401 in a folded position inside the pocket 3201.

Figure 37:
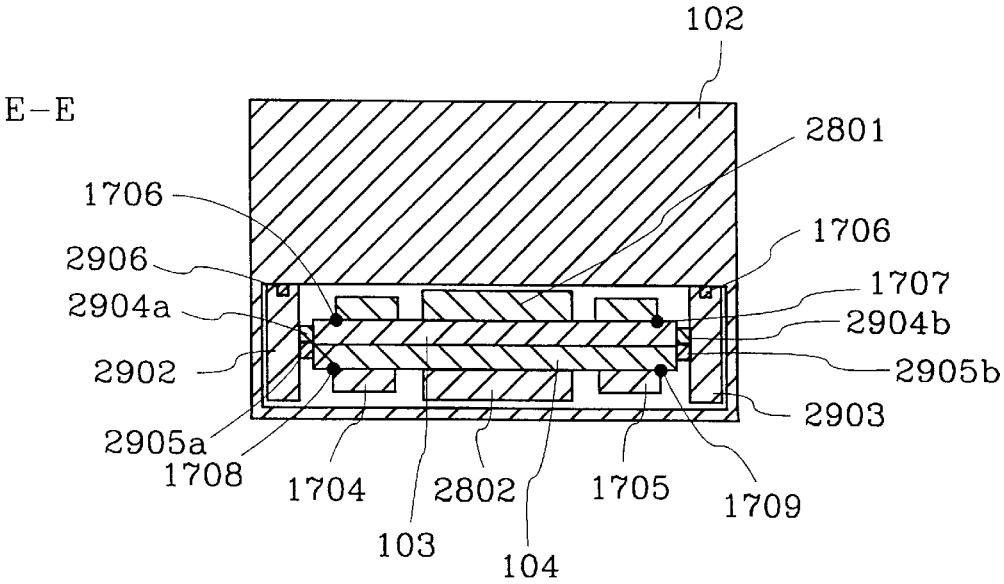
FIG. 37 is a cross-section of the antenna and terminal unit shown in FIG. 36.

FIG. 37 is a cross-section through line E—E, shown in FIG. 36, of the antenna unit 3401, the terminal unit 102 and two battery units 2801, 2802 respectively. The battery unit 2801 is attached to the bottom surface 206 and between the folded extensions 1702 and 1703 of the first antenna body 103. The battery unit 2802 is attached to the bottom surface 212 and between the folded extensions 1704 and 1705 of the second antenna body 104.

The antenna units 2901 and 3401 can also be folded with their top surfaces 205 and 211, see FIGS. 2*a–b*, facing each other.

The unfolded antenna units 2901 and 3401 in FIGS. 29 and 34 are arranged in a horizontal position. The unfolded antenna units 2901 and 3401 can also be arranged in a position between the horizontal position and a vertical position.

The antenna units 101, 301, 701, 1401, 1701, 2301, 2901 and 3401 in many of the figures are as examples attached to a terminal unit 102. The antenna units can also be attached to other portable radio units such as pagers, telex, electronic notebooks and communicators, capable of operating in a satellite communication system.

What is claimed is:

1. An antenna unit for transmitting and receiving signals from/to a portable radio terminal unit, wherein said antenna unit is movably attached to said radio terminal, said antenna unit comprising:

a first antenna body with reception means for receiving radio signals;

a second antenna body with transmitting means for transmitting radio signals, said second antenna body arranged to be slidingly inserted into and slidingly pulled out of said first antenna body; and wherein said first antenna body comprises:

a first and a second side portion;

a first and a second end portion; and a top and a bottom surface, where said bottom surface has a first portion which is extending in a longitudinal direction next to said first side portion and a second portion which is extending in a longitudinal direction next to said second side portion; and wherein said second antenna body comprises:

a first and a second side portion;

a first and a second end portion; and a top and a bottom surface, where said bottom surface has a first portion which is extending in a longitudinal direction next to said first side portion of said second antenna body and a second portion which is extending in a longitudinal direction next to said second side portion of said second antenna body.

2. The antenna unit as claimed in claim 1, characterized in that a first array of patches is arranged on said top surface of said first antenna body and that a second array of patches is arranged on said top surface of said second antenna body.

3. The antenna unit as claimed in claim 1, characterized in that said antenna unit comprises a first attachment coupled to the first end portion of the first antenna body, where said first attachment is arranged to be attached to said terminal unit.

4. The antenna unit as claimed in claim 3, characterized in that said first attachment is arranged to enable the antenna to be folded onto said terminal unit, unfolded from said terminal unit, and positioned at a specified first angle related to said terminal unit.

5. The antenna unit as claimed in claim 1, characterized in that a battery unit being attached on said bottom surface of said second antenna body to supply power to the transmitting and reception means.

6. The antenna unit as claimed in claim 1, characterized in that a second attachment is coupled to the second end portion of the first antenna body and to the first end portion of the second antenna body.

7. The antenna unit as claimed in claim 6, characterized in that said second attachment is arranged to enable the second antenna body to be folded onto the first antenna body in such a way that the top surface of the second antenna body faces the top surface of the first antenna body.

8. The antenna unit as claimed in claim 7, characterized in that said second attachment is arranged to enable the second antenna body to be unfolded from the first antenna body and to maintain its position in such a way that a normal vector of the top surface of the second antenna body faces the same direction as a normal vector of the top surface of the first antenna body.

9. The antenna unit as claimed in claim 6, characterized in that said second attachment is arranged to enable the second antenna body to be folded onto the first antenna body in such a way that the bottom surface of the second antenna body faces the bottom surface of the first antenna body.

10. The antenna unit as claimed in claim 9, characterized in that said second attachment is arranged to enable the second antenna body to be unfolded from the first antenna body and to maintain its position in such a way that a normal vector of the top surface of the second antenna body faces the same direction as a normal vector of the top surface of the first antenna body.

11. The antenna unit as claimed in claim 6, characterized in that a battery unit being attached on said bottom surface of said second antenna body to supply power to the transmitting and reception means.

12. The antenna unit as claimed in claim 6, characterized in that a battery unit being attached on said bottom surface of said first antenna body to supply power to the transmitting and reception means.

13. The antenna unit as claimed in claim 6, characterized in that battery units being attached on said bottom surface of said first antenna body and on said bottom surface of said second antenna body to supply power to the transmitting and reception means.

14. The antenna unit as claimed in claim 1, characterized in that a second attachment is coupled to the second end portion of the first antenna body and to the first end portion of the second antenna body, where said attachment comprises a first and a second end portion.

15. The antenna unit as claimed in claim 14, characterized in that said attachment is arranged to enable the second antenna body and the first antenna body to be folded onto each other in such a way that the bottom surface of the second antenna body faces the bottom surface of the first antenna body.

16. The antenna unit as claimed in claim 14, characterized in that said first end portion of said attachment is coupled to a first guide, and said second end portion of said attachment is coupled to a second guide, where said guides are movably attached to the terminal unit.

17. The antenna unit as claimed in claim 14, characterized in that said first guide is attached to a first rail and that said second guide is attached to a second rail on the back of said terminal unit, which enables said antenna unit to be moved up and down along said terminal unit.

18. The antenna unit as claimed in claim 14, characterized in that a battery unit being attached on said bottom surface of said second antenna body to supply power to the transmitting and reception means.

19. An antenna unit as claimed in claim 14, characterized in that a battery unit being attached on said bottom surface of said first antenna body to supply power to the transmitting and reception means.

20. The antenna unit as claimed in claim 14, characterized in that battery units being attached on said bottom surface of said first antenna body and on said bottom surface of said second antenna body to supply power to the transmitting and reception means.

21. An antenna unit for transmitting and receiving signals from/to a portable radio terminal unit, wherein said antenna unit is movably attached to said radio terminal, said antenna unit comprising:

a first antenna body with reception means for receiving radio signals;

a second antenna body with transmitting means for transmitting radio signals, said first antenna body and said second antenna body moveably arranged to each other; and wherein said first antenna body comprises:

a first and a second side portion;

a first and a second end portion; and a top and a bottom surface, where said bottom surface has a first portion which is extending in a longitudinal direction next to said first side portion and a second portion which is extending in a longitudinal direction next to said second side portion; and wherein said second antenna body comprises:

a first and a second side portion;

a first and a second end portion;

a top and a bottom surface, where said bottom surface has a first portion which is extending in a longitudinal direction next to said first side portion of said second antenna body and a second portion which is extending in a longitudinal direction next to said second side portion of said second antenna body; and a first and a second extension arranged along its first and second side portion respectively in a conformal configuration, wherein each of said extensions has an outer surface facing from each other in substantially opposite directions.

22. The antenna unit as claimed in claim 21, characterized in that said transmitting means includes an array of patches arranged on each of said outer surfaces on said extensions of said second antenna body.

23. The antenna unit as claimed in claim 22, characterized in that said extensions of said first antenna body are arranged to be positioned at a second angle related to said top surface of said first antenna body and that said extensions of said second antenna body are arranged to be positioned at a third angle related to said top surface of said second antenna body.

24. The antenna unit as claimed in claim 23, characterized in that each of said second and third angles are 90 degrees.

25. An antenna unit for transmitting and receiving signals from/to a portable radio terminal unit, wherein said antenna unit is movably attached to said radio terminal, said antenna unit comprising:

a first antenna body with reception means for receiving radio signals;

a second antenna body with transmitting means for transmitting radio signals, said first antenna body and said second antenna body moveably arranged to each other; and wherein said first antenna body comprises:

a first and a second side portion;

a first and a second end portion;

a top and a bottom surface, where said bottom surface has a first portion which is extending in a longitudinal direction next to said first side portion and a second portion which is extending in a longitudinal direction next to said second side portion; and a first and a second extension arranged along its first and second side portion, respectively in a conformal configuration, wherein each of said extensions has an outer surface facing from each other in substantially opposite directions; and wherein said second antenna body comprises:

a first and a second side portion;

a first and a second end portion; and a top and a bottom surface, where said bottom surface has a first portion which is extending in a longitudinal direction next to said first side portion of said second antenna body and a second portion which is extending in a longitudinal direction next to said second side portion of said second antenna body.

26. An antenna unit for transmitting and receiving signals from/to a portable radio terminal unit, wherein said antenna unit is movably attached to said radio terminal, said antenna unit comprising:

a first antenna body with reception means for receiving radio signals;

a second antenna body with transmitting means for transmitting radio signals, said first antenna body and said second antenna body moveably arranged to each other; and wherein said first antenna body comprises:

a first and a second side portion;

a first and a second end portion; and a top and a bottom surface, where said bottom surface has a first portion which is extending in a longitudinal direction next to said first side portion and a second portion which is extending in a longitudinal direction next to said second side portion; and wherein said second antenna body comprises:

a first and a second side portion;

a first and a second end portion;

a top and a bottom surface, where said bottom surface has a first portion which is extending in a longitudinal direction next to said first side portion of said second antenna body and a second portion which is extending in a longitudinal direction next to said second side portion of said second antenna body; and a guide along said first and second side portion of said second antenna body and that said first antenna body comprises a rail attached to said first and second side portion of the first antenna body, where said guides are arranged to be inserted into said rails.

27. An antenna unit for transmitting and receiving signals from/to a portable radio terminal unit, wherein said antenna unit is movably attached to said radio terminal, said antenna unit comprising:

a first antenna body with reception means for receiving radio signals;

a second antenna body with transmitting means for transmitting radio signals, said first antenna body and said second antenna body moveably arranged to each other; and wherein said first antenna body comprises:

a first and a second side portion;

a first and a second end portion;

a top and a bottom surface, where said bottom surface has a first portion which is extending in a longitudinal direction next to said first side portion and a second portion which is extending in a longitudinal direction next to said second side portion; and two extensions arranged on and along the respectively first and second portion of said bottom surface of said first antenna body, wherein each of said extensions has an outer surface facing from each other in substantially opposite directions; and wherein said second antenna body comprises:

a first and a second side portion;

a first and a second end portion;

a top and a bottom surface, where said bottom surface has a first portion which is extending in a longitudinal direction next to said first side portion of said second antenna body and a second portion which is extending in a longitudinal direction next to said second side portion of said second antenna body; and wherein the antenna unit further comprises a second attachment coupled to the second end portion of the first antenna body and to the first end portion of the second antenna body.

28. The antenna unit as claimed in claim 27, characterized in that said extensions on said first antenna body are foldable arranged on said first antenna body.

29. The antenna unit as claimed in claim 28, characterized in that each of said extensions on said first antenna body being arranged to be folded against said bottom surface of said first antenna body.

30. The antenna unit as claimed in claims 27, characterized in that said reception means includes an array of patches arranged on each of said outer surfaces on said extensions of said first antenna body.

31. An antenna unit for transmitting and receiving signals from/to a portable radio terminal unit, wherein said antenna unit is movably attached to said radio terminal, said antenna unit comprising:

a first antenna body with reception means for receiving radio signals;

a second antenna body with transmitting means for transmitting radio signals, said first antenna body and said second antenna body moveably arranged to each other; and wherein said first antenna body comprises:

a first and a second side portion;

a first and a second end portion; and a top and a bottom surface, where said bottom surface has a first portion which is extending in a longitudinal direction next to said first side portion and a second portion which is extending in a longitudinal direction next to said second side portion; and wherein said second antenna body comprises:

a first and a second side portion;

a first and a second end portion; and a top and a bottom surface, where said bottom surface has a first portion which is extending in a longitudinal direction next to said first side portion of said second antenna body and a second portion which is extending in a longitudinal direction next to said second side portion of said second antenna body; and two extensions arranged on and along the respectively first and second portion of said bottom surface of said second antenna body, where each of said extensions has an outer surface facing from each other in substantially opposite directions; and wherein the antenna unit further comprises a second attachment coupled to the second end portion of the first antenna body and to the first end portion of the second antenna body.

32. The antenna unit as claimed in claim 31, characterized in that said extensions on said second antenna body are foldable arranged on said second antenna body.

33. The antenna unit as claimed in claim 32, characterized in that each of said extensions on said second antenna body being arranged to be folded against said bottom surface of said second antenna body.

34. The antenna unit as claimed in claim 31, characterized in that said transmitting means includes an array of patches arranged on each of said outer surfaces on said extensions of said second antenna body.

35. The antenna unit as claimed in claim 31, characterized in that said ex tensions of said first antenna body are arranged to be positioned at a second angle related to said top surface of said first antenna body, and that said extensions of said second antenna body are arranged to be positioned at a third angle related to said top surface of said second antenna body.

36. An antenna unit for transmitting and receiving signals from/to a portable radio terminal unit, wherein said antenna unit is movably attached to said radio terminal, said antenna unit comprising:

a first antenna body with reception means for receiving radio signals;

a second antenna body with transmitting means for transmitting radio signals, said first antenna body and said second antenna body moveably arranged to each other; and wherein said first antenna body comprises:

a first and a second side portion;

a first and a second end portion; and a top and a bottom surface, where said bottom surface has a first portion which is extending in a longitudinal direction next to said first side portion and a second portion which is extending in a longitudinal direction next to said second side portion; and wherein said second antenna body comprises:

a first and a second side portion;

a first and a second end portion; and a top and a bottom surface, where said bottom surface has a first portion which is extending in a longitudinal direction next to said first side portion of said second antenna body and a second portion which is extending in a longitudinal direction next to said second side portion of said second antenna body; and wherein the antenna unit further comprises a second attachment coupled to the second end portion of the first antenna body and to the first end portion of the second antenna body, where said attachment comprises a first and second end portion; and wherein said first antenna body further comprises two extensions arranged on and along the respectively first and second portion of said bottom surface of said first antenna body, where each of said extensions has an outer surface facing from each other in substantially opposite directions, where said reception means includes an array of patches arranged on each of said outer surfaces.

37. The antenna unit as claimed in claim 36, characterized in that said extensions on said first antenna body are foldable arranged on said first antenna body.

38. The antenna unit as claimed in claim 36, characterized in that said second antenna body comprises two extensions arranged on and along the respectively first and second portion of said bottom surface of said second antenna body, where each of said extensions has an outer surface facing from each other in substantially opposite directions, where said reception means includes an array of patches arranged on each of said outer surfaces.

39. The antenna unit as claimed in claim 38, characterized in that said extensions on said second antenna body are foldable arranged on said second antenna body.

40. A portable radio unit including a terminal unit with radio transmitting and receiving circuits elements and a movably attached antenna unit, said antenna unit comprising:

a first antenna body with a first array of patches with electrically steerable beams for receiving radio signals;

a second antenna body with a second array of patches with electrically steerable beams for transmitting radio signals; and wherein said first antenna body and said second antenna body are movably arranged to each other; and further wherein said second antenna body is arranged to be slidingly inserted into and slidingly pulled out of said first antenna body.

41. The portable radio unit as claimed in claim 40, characterized in that a second attachment is coupled to a second end portion of the first antenna body and to a first end portion of the second antenna body, where said second attachment is arranged to enable the second antenna body to be folded onto the first antenna body in such a way that a top surface of the second antenna body faces a top surface of the first antenna body.

42. The portable radio unit as claimed in claim 40, characterized in that a second attachment is coupled to a second end portion of the first antenna body and to a first end portion of the second antenna body, where said second attachment is arranged to enable the second antenna body to be folded onto the first antenna body in such a way that a bottom surface of the second antenna body faces a bottom surface of the first antenna body.

43. A portable radio unit including a terminal unit with radio transmitting and receiving circuits elements and a movably attached antenna unit, said antenna unit comprising:

a first antenna body with a first array of patches with electrically steerable beams for receiving radio signals;

a second antenna body with a second array of patches with electrically steerable beams for transmitting radio signals; and wherein said first antenna body and said second antenna body are movably arranged to each other; and further wherein said first antenna body further comprises two extensions where each of said extensions has an outer surface facing from each other in substantially opposite directions, and where said reception means includes an array of patches arranged on each of said outer surfaces on said extensions of said first antenna body.

44. A portable radio unit including a terminal unit with radio transmitting and receiving circuits elements and a movably attached antenna unit, said antenna unit comprising:

a first antenna body with a first array of patches with electrically steerable beams for receiving radio signals;

a second antenna body with a second array of patches with electrically steerable beams for transmitting radio signals; and wherein said first antenna body and said second antenna body are movably arranged to each other; and further wherein said second antenna body includes two extensions where each of said extensions has an outer surface facing from each other in substantially opposite directions, and where said transmitting means includes an array of patches arranged on each of said outer surfaces on said extensions of said second antenna body.

* * * * *